US009682843B2

(12) United States Patent
Nakagawa

(10) Patent No.: US 9,682,843 B2
(45) Date of Patent: Jun. 20, 2017

(54) ELEVATOR GROUP MANAGEMENT SYSTEM

(71) Applicant: FUJITEC CO., LTD., Hikone-shi, Shiga (JP)

(72) Inventor: Masami Nakagawa, Hikone (JP)

(73) Assignee: FUJITEC CO., LTD., Hikone-shi (JP)

( * ) Notice: Subject to any disclaimer, the term of this patent is extended or adjusted under 35 U.S.C. 154(b) by 456 days.

(21) Appl. No.: 14/498,853

(22) Filed: Sep. 26, 2014

(65) Prior Publication Data

US 2015/0090535 A1 Apr. 2, 2015

(30) Foreign Application Priority Data

Sep. 30, 2013 (JP) ..... 2013-205257

(51) Int. Cl.
*B66B 1/18* (2006.01)
*B66B 1/24* (2006.01)

(52) U.S. Cl.
CPC ..... *B66B 1/2458* (2013.01); *B66B 2201/103* (2013.01); *B66B 2201/211* (2013.01); *B66B 2201/214* (2013.01)

(58) Field of Classification Search
CPC ..... B66B 1/2458; B66B 2201/103; B66B 2201/211; B66B 2201/214
USPC ..... 187/247, 380–389, 391–393
See application file for complete search history.

(56) References Cited

U.S. PATENT DOCUMENTS 5,331,121 A * 7/1994 Tsuji ..... B66B 1/2408 187/388
6,360,849 B1 * 3/2002 Hikita ..... B66B 1/18 187/381
6,619,437 B2 * 9/2003 Hikita ..... B66B 1/18 187/383
7,426,982 B2 * 9/2008 Yoshikawa ..... B66B 1/2458 187/247
7,487,860 B2 * 2/2009 Hikita ..... B66B 1/2433 187/249
7,568,556 B2 * 8/2009 Hikita ..... B66B 1/2458 187/247
8,006,807 B2 * 8/2011 Kobori ..... B66B 1/2458 187/247
8,567,569 B2 * 10/2013 Suzuki ..... B66B 1/2458 187/247
8,960,374 B2 * 2/2015 Nakagawa ..... B66B 1/2458 187/247

FOREIGN PATENT DOCUMENTS

JP 2011-032053 A 2/2011

* cited by examiner

*Primary Examiner* — Anthony Salata
(74) *Attorney, Agent, or Firm* — Westerman, Hattori, Daniels & Adrian, LLP

(57) ABSTRACT

When a specific destination floor call is made, the control unit assigns an elevator of which waiting time is within the reference time from the plurality of elevators to the specific destination floor call, the waiting time being a time from a time when the specific destination floor call is made to a time when the specific user can get on an elevator at the specific floor. Further, when a general destination floor call is made, the control unit assigns one of the plurality of elevators in response to the general destination floor call such that an elevator of which waiting time to the specific destination floor call that is made after the general destination floor call is within the reference time is left.

6 Claims, 15 Drawing Sheets

ELEVATOR GROUP MANAGEMENT SYSTEM

This application is based on application No. 2013-205257 filed on Japan, the contents of which is herein incorporated by reference.

BACKGROUND

1. Technical Field

The present invention relates to an elevator group management system that can assign one of a plurality of elevators based on a registered destination floor to a destination floor call.

2. Related Art

JP-2011-32053-A discloses an elevator group management system that has a destination floor registering device with which a user registers a destination floor, and a control device that assigns one of a plurality of elevators based on the destination floor registered in the destination floor registering device.

SUMMARY

The elevator group management system that includes the destination floor registering device is required to preferentially provides service to a specific user.

An object of the present invention is to preferentially provide service to a specific user in an elevator group management system that includes a destination floor registering device.

An elevator group management system according to a first aspect of the present invention has a destination floor registering device with which a user registers a destination floor, and a control device configured to assign one of a plurality of elevators based on the destination floor registered with the destination floor registering device to a destination floor call that is based on the destination floor.

The destination floor registering device includes a destination floor input unit configured to input a destination floor from the user, and output a signal related to the input destination floor to the control device, and a user input unit configured to receive from a specific user, information indicating that a user inputting the information is the specific user, and output to the control device a specific signal indicating that a user is the specific user.

The control device includes a storage unit configured to store a reference time and a specific floor associated with the specific user, and a control unit.

When the destination floor call is a specific destination floor call, the control unit assigns an elevator of which waiting time is within the reference time from the plurality of elevators to the destination floor call, the specific destination floor call being a call made with the specific signal is inputted when the signal related to the destination floor is inputted from the destination floor registering device, the waiting time being a time from a time when the specific destination floor call is made to a time when the specific user can get on an elevator at the specific floor. Further, the destination floor call is a general destination floor call, the control unit assigns one of the plurality of elevators in response to the general destination floor call to the destination floor call such that an elevator of which waiting time to the specific destination floor call which is made after the general destination floor call is within the reference time is left, the general destination floor call being a call made with the specific signal not inputted when the signal related to the destination floor is inputted from the destination floor registering device.

An elevator group management system according to a second aspect of the present invention has a destination floor registering device with which a user registers a destination floor, and a control device configured to assign one of a plurality of elevators based on the destination floor registered with the destination floor registering device to a destination floor call that is based on the destination floor.

The destination floor registering device includes a destination floor input unit configured to input a destination floor from the user, and output a signal related to the inputted destination floor to the control device, and a user input unit configured to receive from a specific user, information indicating that a user inputting the information is the specific user, and output to the control device a specific signal indicating that a user is the specific user.

The control device includes a storage unit configured to store a reference time and a specific floor associated with the specific user, and a control unit.

When the destination floor call is a specific destination floor call, the control unit assigns an elevator of which service completion time is within the reference time from the plurality of elevators to the destination floor call, the specific destination floor call being a call made with the specific signal is inputted when the signal related to the destination floor is inputted from the destination floor registering device, the service completion time being a time from a time when the specific user gets on an elevator at the specific floor after a specific destination floor call is made to a time when the specific user can get off the elevator at the destination floor. Further, when the destination floor call is a general destination floor call, the control unit assigns one of the plurality of elevators in response to the general destination floor call to the destination floor call such that an elevator of which service completion expected time at which a service is expected to complete to the specific destination floor call which is made after the general destination floor call is within the reference time is left, the general destination floor call being a call made with the specific signal not inputted when the signal related to the destination floor is inputted from the destination floor registering device.

According to the present invention, when a general destination floor call is made, one of a plurality of elevators is assigned in response to the general destination floor call such that an elevator of which waiting time to a specific destination floor call that is made after the general destination floor call is within a reference time is left. Further, one of a plurality of elevators is assigned in response to the general destination floor call such that an elevator of which service completion expected time to the specific destination floor call that is made after the general destination floor call is within a reference time is left. Consequently, the specific user can get on one of the elevators within the reference time after inputting a destination floor, or can get off the elevator at the destination floor within the reference time after inputting the destination floor. Consequently, the elevator group management system that includes a destination floor registering device can preferentially provide service to specific users.

DETAILED DESCRIPTION OF PREFERRED EMBODIMENTS

An elevator group management system according to embodiments of the present invention will be described with reference to the drawings.

Background of Invention

When preferentially providing service (priority service) to specific users, a conventional elevator group management system having up/down hall call buttons changes an assign of a hall call assigned to a priority service target elevator, to another elevator. A priority service request method includes, for example, presenting an ID card, registering a call at a reception of a building, and registering a call from a remote monitoring device.

By contrast with this, when an elevator group management system having a destination floor registering device changes to another elevator an assign of a call assigned once by distributing calls to a plurality of elevators, an unspecified number of users do not necessarily reliably recognize the assign change. Therefore, the elevator group management system having an elevator hall destination floor registering device has difficulty in changing an assign of calls. It is therefore an object of the present invention to provide an elevator group management system that can provide priority service without, for example, changing an assign of calls.

First Embodiment

1. Configuration

Figure 1:
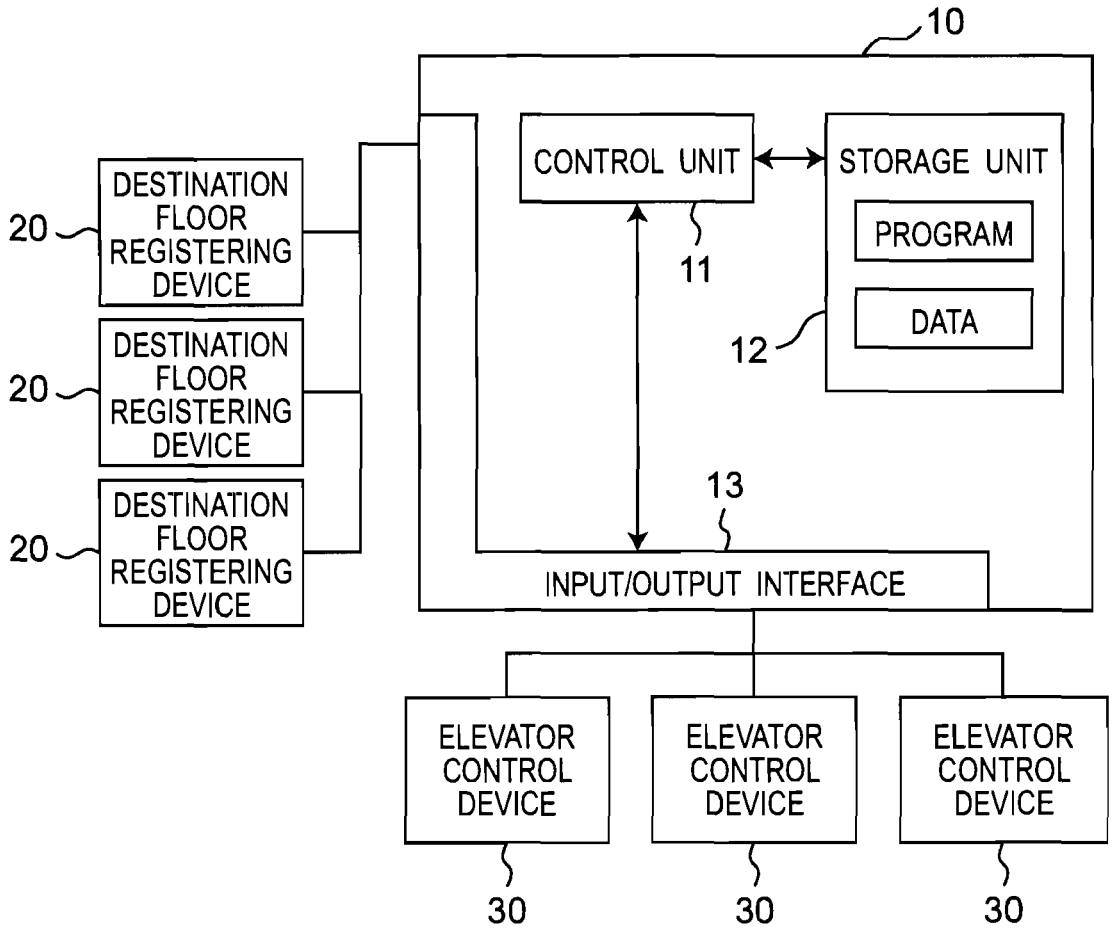
FIG. 1 is a block diagram illustrating a configuration of an elevator group management system according to a first embodiment.

FIG. 1 is a block diagram illustrating a configuration of an elevator group management system according to the first embodiment.

The elevator group management system has a control device 10 (group management control device) and a destination floor registering device 20. The elevator group management system performs overall control on running of a plurality of elevators. Further, the elevator group management system performs control of assigning one of a plurality of elevators in response to the destination floor call registered in the destination floor registering device 20. In the present embodiment, the destination floor registering device 20 is equipped on each floor of a building.

The control device 10 has a control unit 11, a storage unit 12 and an input/output interface 13. The control unit 11 performs various types of control by executing programs stored in the storage unit 12. The storage unit 12 stores the programs and various items of data.

The input/output interface 13 is an interface which transmits and receives signals between the destination floor registering device 20 and a plurality of elevators. The input/output interface 13 converts a signal outputted from the control unit 11, into a signal of a predetermined format, and outputs the signal. Further, the input/output interface 13 converts signals inputted from the destination floor registering devices 20 and a plurality of elevators, into signals of a predetermined format, and outputs the signals to the control unit 11.

Figure 2:
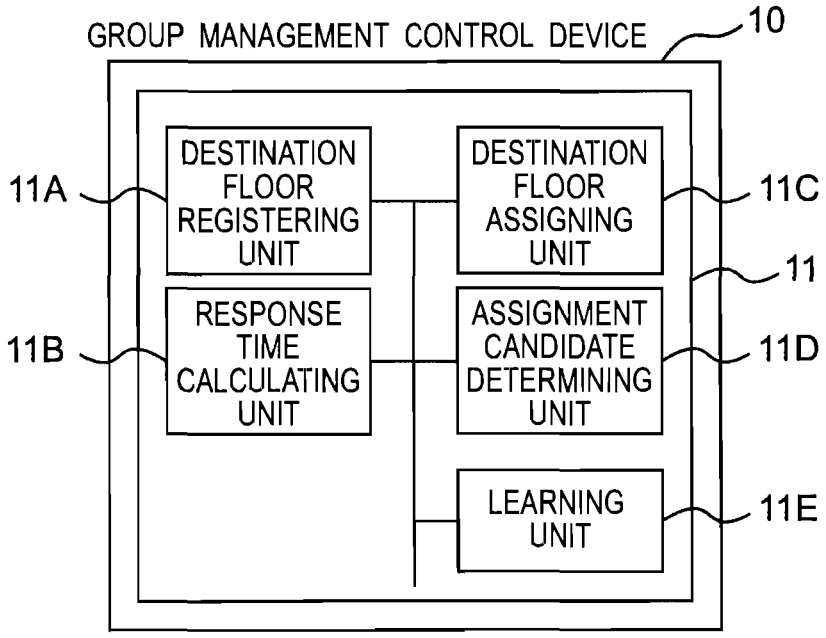
FIG. 2 is a functional block diagram illustrating a function of a control device of the elevator group management system according to the first embodiment.

FIG. 2 is a functional block diagram illustrating a function of the control device 10 of the elevator group management system according to the first embodiment.

The control unit 11 of the control device 10 realizes each function of a destination floor registering unit 11A, a response time calculating unit 11B, a destination floor assigning unit 11C, an assignment candidate determining unit 11D and a learning unit 11E. More specifically, when the destination floor registering device 20 that is installed at an elevator hall receives an input of a destination floor from a user, the destination floor registering device 20 transmits information related to the inputted destination floor call to the control device 10. In this case, the destination floor registering unit 11A of the control device 10 records (registers) information related to the destination floor call that is received from the destination floor registering device 20 through the input/output interface 13, in the storage unit 12. The learning unit 11E learns an inter-floor running time, a door opening/closing time, a stop time and a call occurrence frequency based on information related to an elevator state (e.g. a running state, a door state and a load state) received from elevator control device 30 and information related to a call registration state. The response time calculating unit 11B calculates a time (response time (waiting time)) which is required for each elevator to respond to a call from an arbitrary floor, based on information related to the call registration state, information related to each elevator state and a learning result of the learning unit 11E. The assignment candidate determining unit 11D determines an assignment candidate elevator in response to the registered destination floor call to satisfy service conditions (described below) for a specific user. The destination floor assigning unit 11C determines an assignment elevator to be assigned in response to the registered destination floor call from the assignment candidate elevators set by the assignment candidate determining unit 11D to optimize the entire service for the purpose of reducing an average waiting time. The destination floor assigning unit 11C transmits a command signal for causing the elevator to provide service in response to the destination floor call, to the elevator control device 30 of the determined assignment elevator. Further, the destination floor assigning unit 11C transmits a signal related to the assignment elevator, to the destination floor registering device 20 to which the destination floor call is inputted. When receiving the command signal, the elevator control device 30 drives an elevator cage in response to the destination floor call in a traveling direction. Further, when receiving the signal related to the assignment elevator, the destination floor registering device 20 causes an assignment elevator display unit 24*a* of a display unit 24 to display information indicating the signal related to the assignment elevator, based on the signal related to the assignment elevator received from the control device 10.

Figure 3:
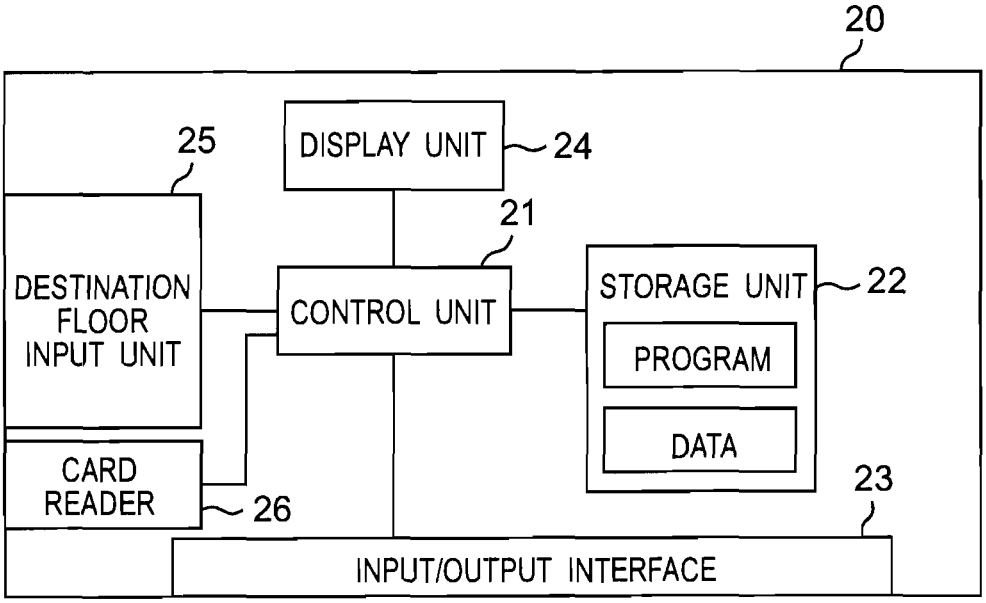
FIG. 3 is a block diagram illustrating a configuration of a destination floor registering device of the elevator group management system according to the first embodiment.

FIG. 3 is a block diagram illustrating a configuration of the destination floor registering device 20 of the elevator group management system according to the first embodiment.

The destination floor registering device 20 has a control unit 21, a storage unit 22, an input/output interface 23, the display unit 24, a destination floor input unit 25 and a card reader 26.

The control unit 21 performs various types of control by executing programs stored in the storage unit 22.

The storage unit 22 stores the programs and various items of data. The storage unit 22 stores data such as an ID and an installation floor of the destination floor registering device 20. Further, the storage unit 22 stores service conditions for a specific user. The storage unit 22 stores a specific service target floor (a specific floor where a specific user can receive priority service by presenting an ID card, and is referred to as a "specific service target floor" below) and a reference time as, for example, service (specific service) conditions for specific users. Further, the storage unit 22 optionally updates and stores information related to an elevator state (e.g. a running state, a door state and a load state) received from each elevator control device 30, a learned inter-floor running time, door opening/closing time, stop time and call occurrence frequency.

The input/output interface 23 is an interface which transmits and receives signals to and from the control device 10. The input/output interface 23 converts a signal outputted from the control unit 21, into a signal of a predetermined format, and outputs the signal. Further, the input/output interface 23 converts a signal inputted from the control device 10, into a signal of a predetermined format, and outputs the signal to the control unit 21.

The display unit 24 displays an indication based on a display signal outputted from the control unit 21.

The destination floor input unit 25 is an interface through which a user inputs a destination floor. In the present embodiment, numerical keypads are adopted as the destination floor input unit 25 as illustrated in, for example, FIG. 4. The destination floor input unit 25 outputs a signal related to, for example, the destination floor to the control unit 21.

The card reader 26 reads information recorded in an ID card when the ID card for using a predetermined function of the elevator is presented. The card reader 26 and the ID card may be an IC card or a magnetic card. In the ID card, information indicating an ID code of the ID card, information indicating that a user of the ID card is a specific user, and information indicating a destination floor related to a destination floor call that is made by the specific user are recorded. When the ID card is presented and the card reader 26 reads ID information and the like recorded in the ID card, the card reader 26 outputs a signal (specific signal) indicating the read information to the control unit 21.

In addition, a destination floor may be stored in the storage unit 22 of the destination floor registering device 20 or the storage unit 12 of the control device 10 in advance in association with the ID code of the ID card, and, when the card reader 26 recognizes the ID code of the ID card, the control device 10 may automatically set the destination floor based on the ID code.

Figure 4:
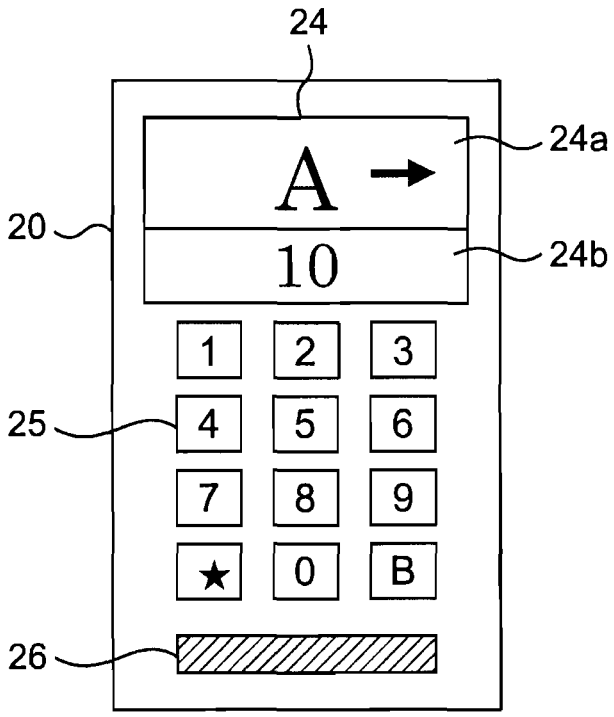
FIG. 4 is a view illustrating an external appearance of the destination floor registering device of the elevator group management system according to the first embodiment.

FIG. 4 is a view illustrating an external appearance of the destination floor registering device 20 of the elevator group management system according to the first embodiment. The display unit 24 is arranged at an upper portion in a front surface of the destination floor registering device 20. The display unit 24 has the assignment elevator display unit 24*a* which displays an assignment elevator, and a destination floor display unit 24*b* which displays a destination floor. The destination floor input unit 25 is arranged in the center portion in the front surface of the destination floor registering device 20. The card reader 26 is arranged at a lower portion in the front surface of the destination floor registering device 20.

2. Operation

An operation executed in the elevator group management system will be described.

When an operation of specifying a destination floor is performed on the destination floor input unit 25 of the destination floor registering device 20, the destination floor input unit 25 outputs a destination floor call signal including information of a destination floor and the like to the control unit 21 of the destination floor registering device 20. The control unit 21 performs predetermined processing on the destination floor call signal corresponding to the specifying operation, and then outputs the processed signal to the control device 10 through the input/output interface 23.

Further, when an ID card is presented to the card reader 26 of the destination floor registering device 20, the card reader 26 reads ID information and the like recorded in the ID card, and outputs a signal indicating the read ID information and the like to the control unit 21. The control unit 21 performs predetermined processing on the signal indicating the ID information and the like, and then outputs the processed signal to the control device 10 through the input/output interface 23.

When receiving the destination floor call signal from the destination floor registering device 20, the control device 10 determines whether or not the signal indicating the ID information and the like is received from the destination floor registering device 20 within a predetermined time before or after the reception of the destination floor call signal. Further, when receiving the signal indicating the ID information and the like from the card reader 26 within the predetermined time before the reception of the destination floor call signal (a signal indicating the specific user), the control device 10 executes the subsequent control assuming that the specific user made the destination floor call (optionally referred to as a "specific destination floor call" below). By contrast with this, when not receiving the signal indicating the ID information and the like from the destination floor registering device 20 within the predetermined time before the reception of the destination floor call signal (a signal indicating the specific user), the control device 10 executes the subsequent control assuming that a general user made the destination floor call (optionally referred to as a "general destination floor call" below).

Further, the control device 10 determines assignable elevators (optionally referred to as "assignment candidate elevators" below) according to whether the destination floor call received from the destination floor registering device 20 is a specific destination floor call or a general destination floor call.

First, an operation of assigning an elevator when a general destination floor call is made will be described. Next, an operation of assigning an elevator when a specific destination floor call is made will be described.

Figure 5:
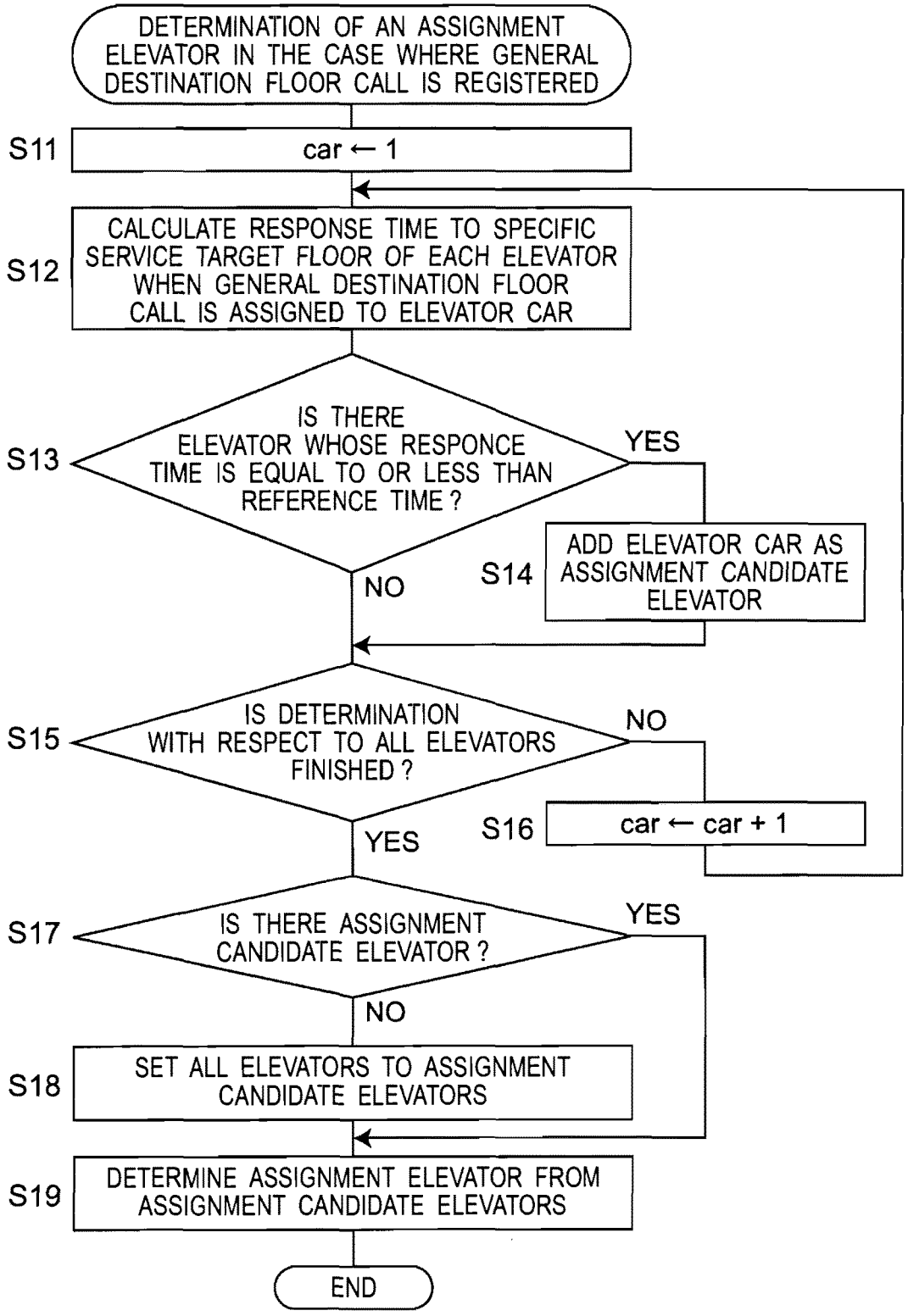
FIG. 5 is a flowchart illustrating a flow of an elevator assigning operation executed in response to a general destination floor call in the elevator group management system according to the first embodiment.

FIG. 5 is a flowchart illustrating a flow of the operation executed in response to a general destination floor call in an elevator group management system according to the first embodiment.

First, the control device 10 sets 1 as an elevator number X (S11). In addition, an elevator of which elevator number is X will be optionally referred to as an "elevator X" below. In the embodiment, three elevators (elevator A, elevator B, and elevator C) are provided, and 1, 2, or 3 can be set as the elevator number X. It is noted that elevator A, elevator B, and elevator C correspond to elevator 1, elevator 2, and elevator 3, respectively.

The control device 10 calculates a response time (waiting time) in response to a specific service target floor of each elevator when the general destination floor call is assigned to the elevator X (S12). The response time (waiting time) refers to a time from a time when the specific destination floor call is made to a time when a specific user can get on an elevator at a specific service target floor (a time that the elevator takes to arrive at the specific service target floor). More specifically, the control device 10 calculates the response time based on each current elevator state, a current destination floor call registration state, a learning result and the like. The control device 10 computes the response time assuming that, after finishing services for all destination floor call assigned to each elevator, a response to the specific destination floor call is made. The control device 10 returns to normal service after finishing priority service (after carrying a specific user) without assigning a new destination floor call to an elevator which provides the priority service. In addition, a new call may be assigned assuming that a response is made after priority service is finished.

The control device 10 determines whether or not there is an elevator which can respond to a specific service target floor within the reference time (S13). A determination example will be described concretely below. In addition, in the present embodiment, the reference time is set to, for example, 30 seconds. However, the reference time is not limited to this, and may be longer or shorter than 30 seconds. When the reference time is made longer, it is possible to increase the number of assignment candidate elevators. However, a waiting time of a user who makes a specific destination floor call becomes longer. When the reference time is made shorter, a waiting time of a user who makes a specific destination floor call becomes shorter. However, the number of assignment candidate elevators decreases.

When there is an elevator which can respond to a specific service target floor within the reference time (Yes in S13), the control device 10 adds the elevator X as an assignment candidate elevator (S14). In addition, when it is determined that the elevator X can respond to the specific service target floor within the reference time, the elevator X itself can become an assignment candidate elevator in some cases.

By contrast with this, when there is not an elevator which can respond to the specific service target floor within the reference time (NO in S13), the control device 10 does not add the elevator X as an assignment candidate elevator.

When the determination processing in step S13 or the processing in step S14 is finished, the control device 10 determines whether or not the determination processing in step S13 with respect to all elevators is finished (S15).

When the determination processing in step S15 with respect to all elevators is not finished (NO in S15), the control device 10 adds 1 to the elevator number X (S16), and executes processing subsequent to step S12.

By contrast with this, when the determination processing in step S15 with respect to all elevators is finished (YES in S15), the control device 10 determines whether or not there is an assignment candidate elevator (S17). In this regard, when an elevator assign processing according to the present embodiment is performed, there is at least one assignment candidate elevator which can respond to a specific service target floor within the reference time. However, when there is only one assignment candidate elevator, if specific destination floor calls are simultaneously or nearly simultaneously made from two specific service target floors, an existing assignment candidate elevator can be assigned in response to one of the destination floor calls. However, the existing assignment candidate elevator cannot be assigned to the other destination floor call. Step S17 is provided to deal with a situation which is not normal.

When there is an assignment candidate elevator (YES in S17), the control device 10 determines an assignment elevator to be actually assigned from the assignment candidate elevators (S19).

By contrast with this, when there is not an assignment candidate elevator (NO in S17), all elevators are forcibly set as assignment candidate elevators (S18), and then an assignment elevator to be actually assigned is determined from the assignment candidate elevators (S19).

Next, an elevator assigning operation performed when a specific destination floor call is made in the elevator group management system according to the first embodiment will be described.

Figure 6:
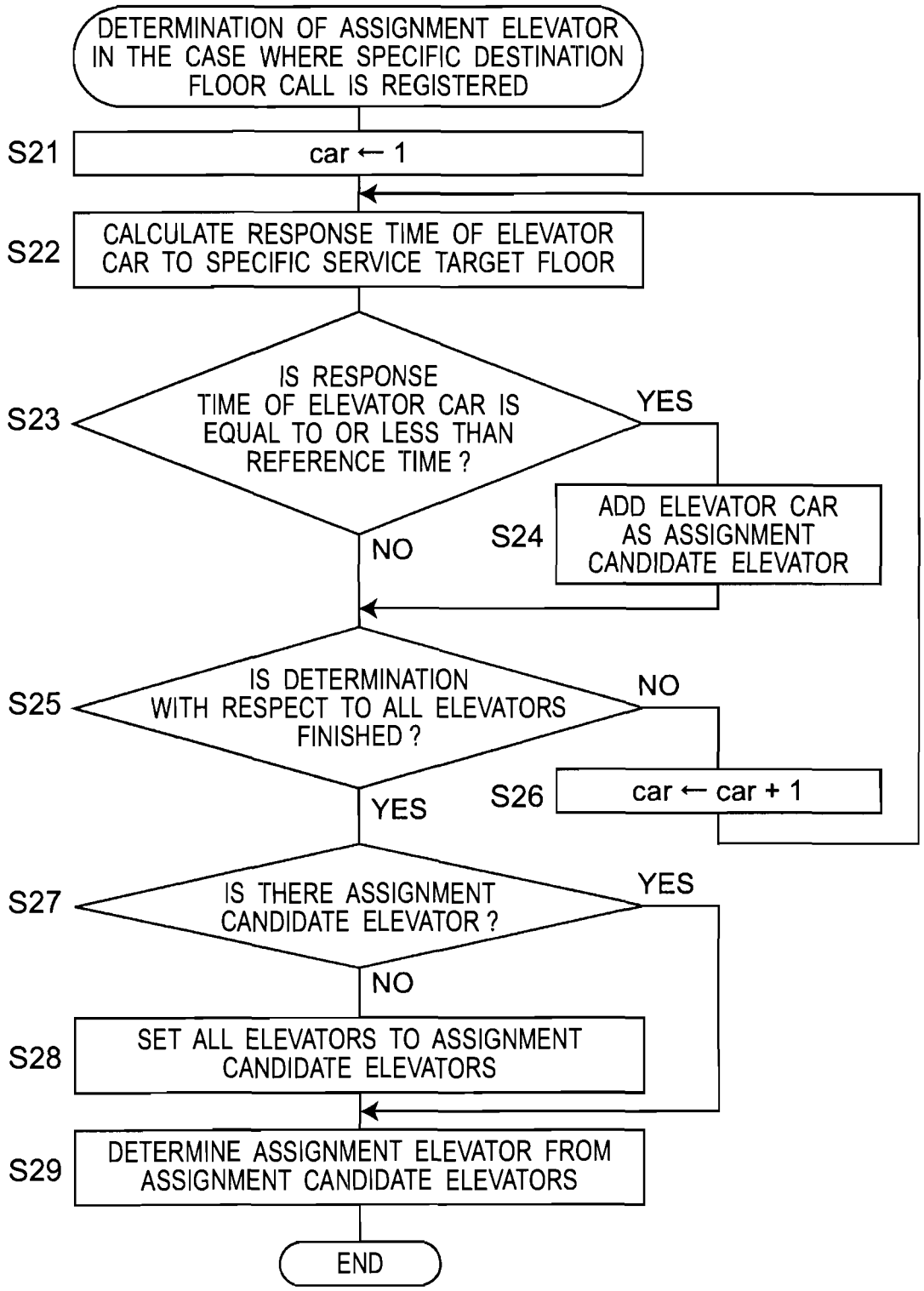
FIG. 6 is a flowchart illustrating a flow of an elevator assigning operation executed in response to a specific destination floor call in the elevator group management system according to the first embodiment.

FIG. 6 is a flowchart illustrating a flow of the operation executed in response to a specific destination floor call in an elevator group management system according to the first embodiment.

First, the control device 10 sets 1 as the elevator number X (S21).

The control device 10 calculates a response time of the elevator X to the specific service target floor in response to the specific destination floor call (S22). More specifically, the control device 10 calculates the response time based on a current elevator state of the elevator X, a current destination floor call registration state, a learning result of the learning unit 11E and the like. In this regard, the response time refers to a time from a time when a specific destination floor call is made to a time when a user can get on an elevator, similar to a general destination floor call.

The control device 10 determines whether or not the calculated response time of the elevator X is equal to or less than the reference time (S23). That is, the control device 10 determines whether or not the elevator X can arrive at the specific service target floor within the reference time. A specific determination example will be described below.

When the calculated response time of the elevator X is equal to or less than the reference time (YES in S23), the control device 10 adds the elevator X as an assignment candidate elevator (S24).

By contrast with this, when the calculated response time of the elevator X is not equal to or less than the reference time (NO in S23), the control device 10 does not add the elevator X as an assignment candidate elevator.

When the determination processing in step S23 or the processing in step S24 is finished, the control device 10 determines whether or not the determination processing in step S23 with respect to all elevators is finished (S25).

When the determination processing in step S25 with respect to all elevators is not finished (NO in S25), the control device 10 adds 1 to the elevator number X (S26), and executes processing subsequent to step S22.

By contrast with this, when the determination processing in step S23 with respect to all elevators is finished (YES in S25), the control device 10 determines whether or not there is an assignment candidate elevator (S27). In this regard, when elevator assign processing according to the present embodiment is performed, there is basically at least one assignment candidate elevator which can respond to a specific service target floor within the reference time. However, when there is only one assignment candidate elevator, if specific destination floor calls are simultaneously or nearly simultaneously made from two specific service target floors, an existing assignment candidate elevator can be assigned in response to one of the destination floor calls. However, the existing assignment candidate elevator cannot be assigned to the other destination floor call. Step S27 is provided to deal with a situation which is not normal.

When there is an assignment candidate elevator (YES in S27), the control device 10 determines an assignment elevator to be actually assigned from the assignment candidate elevators (S29).

By contrast with this, when there is not an assignment candidate elevator (NO in S27), all elevators are forcibly set as assignment candidate elevators (S28), and then an assignment elevator to be actually assigned is determined from the assignment candidate elevators (S29).

(Response Time Calculation Example)

Next, an example of an elevator assigning operation executed in response to a general destination floor call in the elevator group management system according to the first embodiment will be described.

Figure 7:
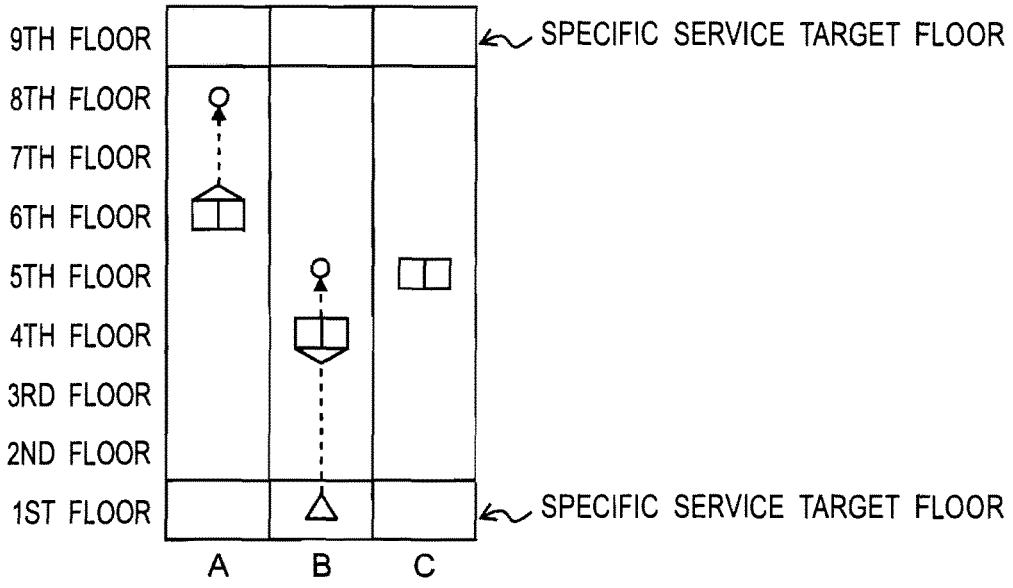
FIG. 7 is a cross-sectional view of an elevator shaft for explaining an elevator assigning operation executed in response to a general destination floor call in the elevator group management system according to the first embodiment.

FIG. 7 is a cross-sectional view of an elevator shaft for explaining an elevator assigning operation executed in response to a general destination floor call in the elevator group management system according to the first embodiment.

In the present example, currently, an elevator A is running up toward the eighth floor which is a destination floor of a passenger. An elevator B is running down to respond to a destination floor call from the first floor, and is scheduled to run up to the fifth floor after having passengers get on the elevator at the first floor. An elevator C is on standby at the fifth floor without receiving a destination floor call.

Figure 8:
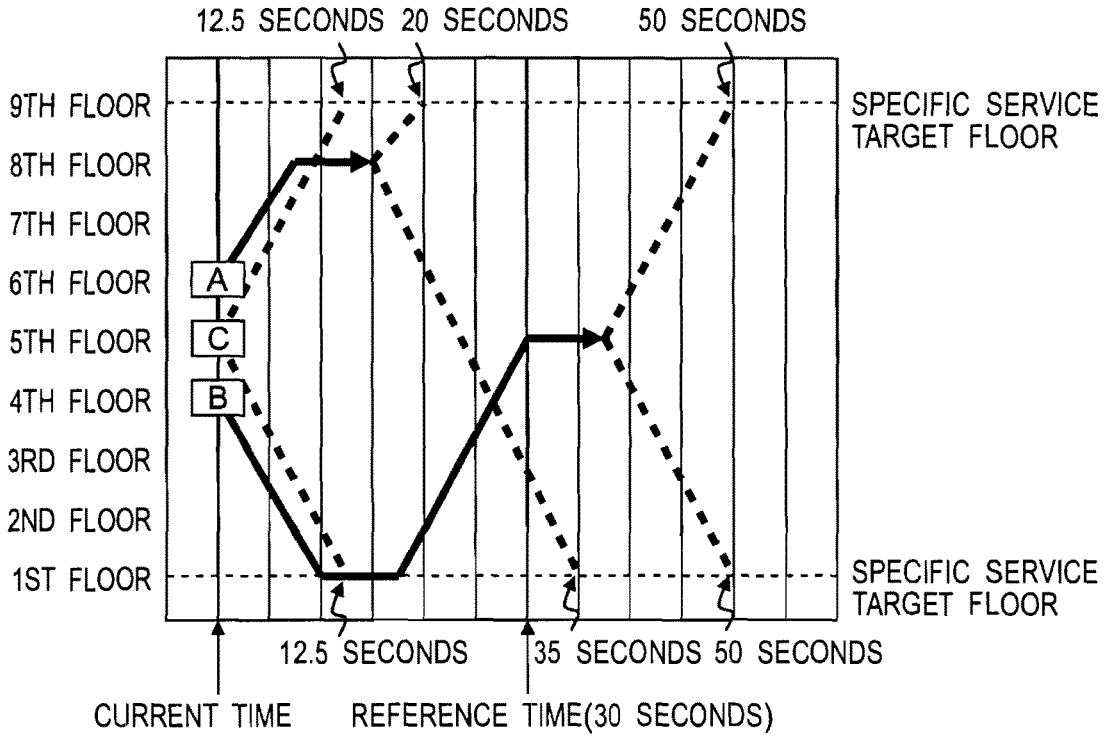
FIG. 8 is an elevator operation diagram for explaining an elevator assigning operation executed in response to a general destination floor call in the elevator group management system according to the first embodiment.

FIG. 8 is an elevator operation diagram for explaining an elevator assigning operation executed in response to a general destination floor call in the elevator group management system according to the first embodiment. More specifically, FIG. 8 is a view illustrating motion of each elevator in FIG. 7 as a line using the horizontal axis for the time and the vertical axis for a floor. Solid lines indicate motions of the elevators in response to registered destination floor calls. Broken lines indicate motions of the elevators when elevators are caused to respond to specific service target floors (the first and ninth floors) within the shortest time. In the present example, the reference time (allowable waiting time) is set to 30 seconds.

In the present example, the elevator A runs up to the eighth floor, and then runs to the specific service target floor (the first or ninth floor). Hence, a response time of the elevator A to the ninth floor is 20 seconds, and the response time to the first floor is 35 seconds. The elevator B runs down to the first floor to respond to the destination floor call from the first floor, has passengers get on the elevator at the first floor, runs up to the fifth floor and then runs to the specific service target floor (the first or ninth floor). Hence, the response time of the elevator B to the ninth floor is 50 seconds, and the response time to the first floor is 50 seconds. The elevator C is on standby at the fifth floor without receiving a destination floor call. Consequently, when receiving a specific destination floor call, the elevator C can immediately run to the specific service target floor (the first or ninth floor). Hence, the response time of the elevator C to the ninth floor is 12.5 seconds, and the response time to the first floor is 12.5 seconds.

Determination Example 1

Figure 9:
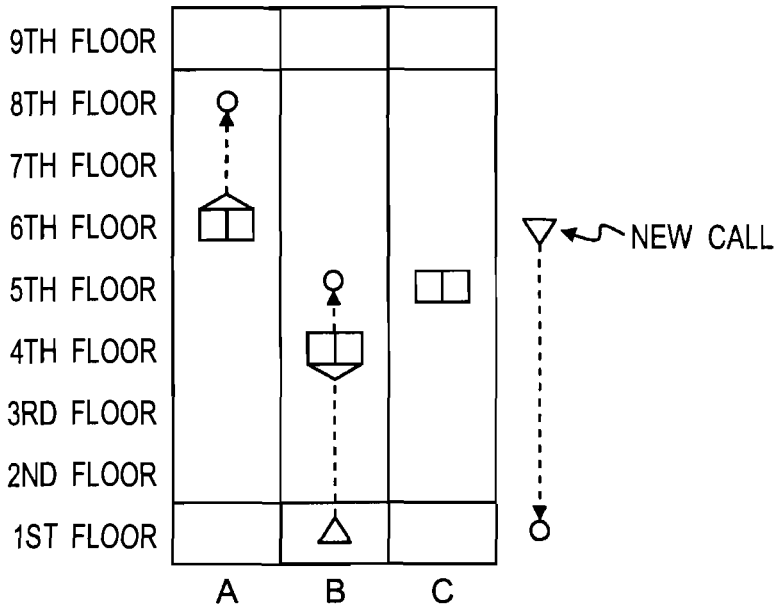
FIG. 9 is a cross-sectional view of an elevator shaft for explaining an elevator assigning operation executed in response to a general destination floor call in the elevator group management system according to the first embodiment (example 1).
Figure 10A:
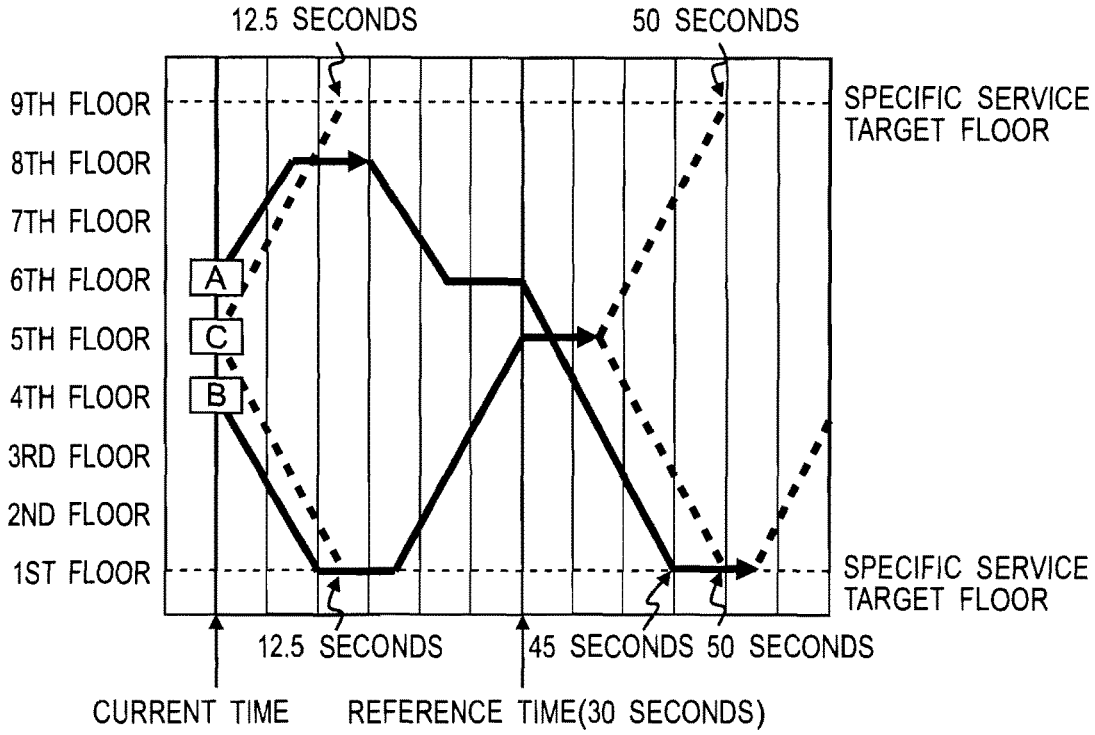
FIG. 10A is an elevator operation diagram for explaining an elevator assigning operation executed in response to a general destination floor call in the elevator group management system according to the first embodiment (example 1), and more specifically, illustrates that a new general destination floor call from a sixth floor to a first floor is temporarily assigned to an elevator A.
Figure 10B:
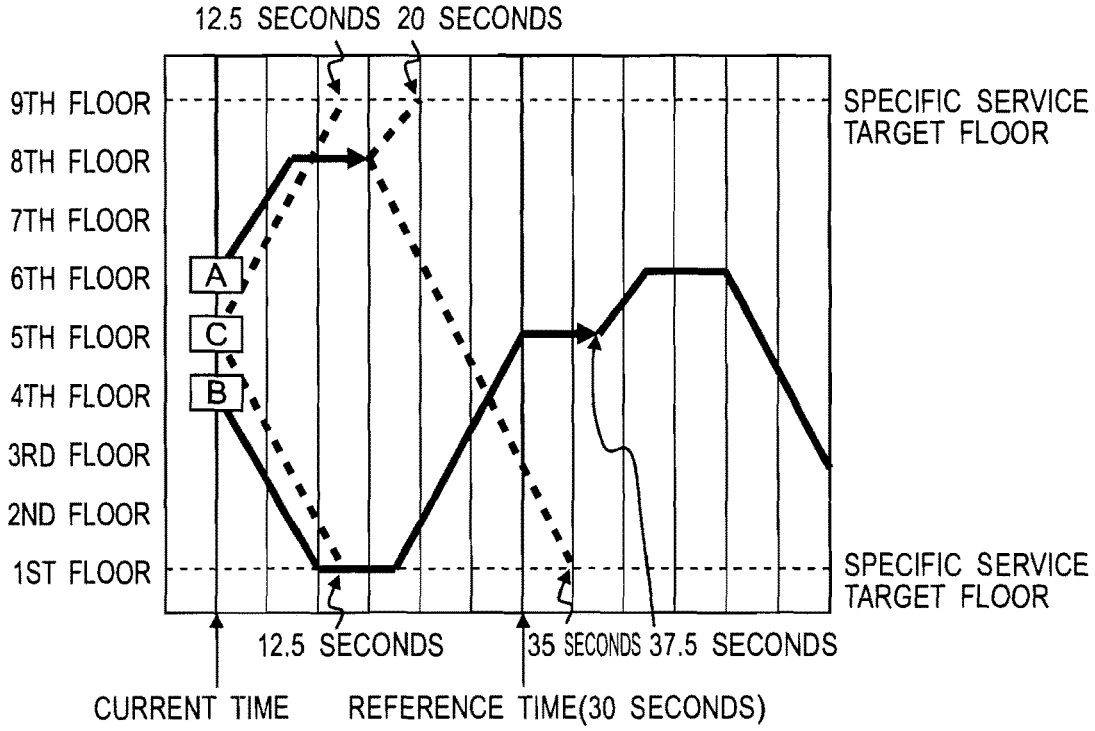
FIG. 10B is an elevator operation diagram for explaining an elevator assigning operation executed in response to a general destination floor call in the elevator group management system according to the first embodiment (example 1), and more specifically, illustrates that a new general destination floor call from the sixth floor to the first floor is temporarily assigned to an elevator B.
Figure 10C:
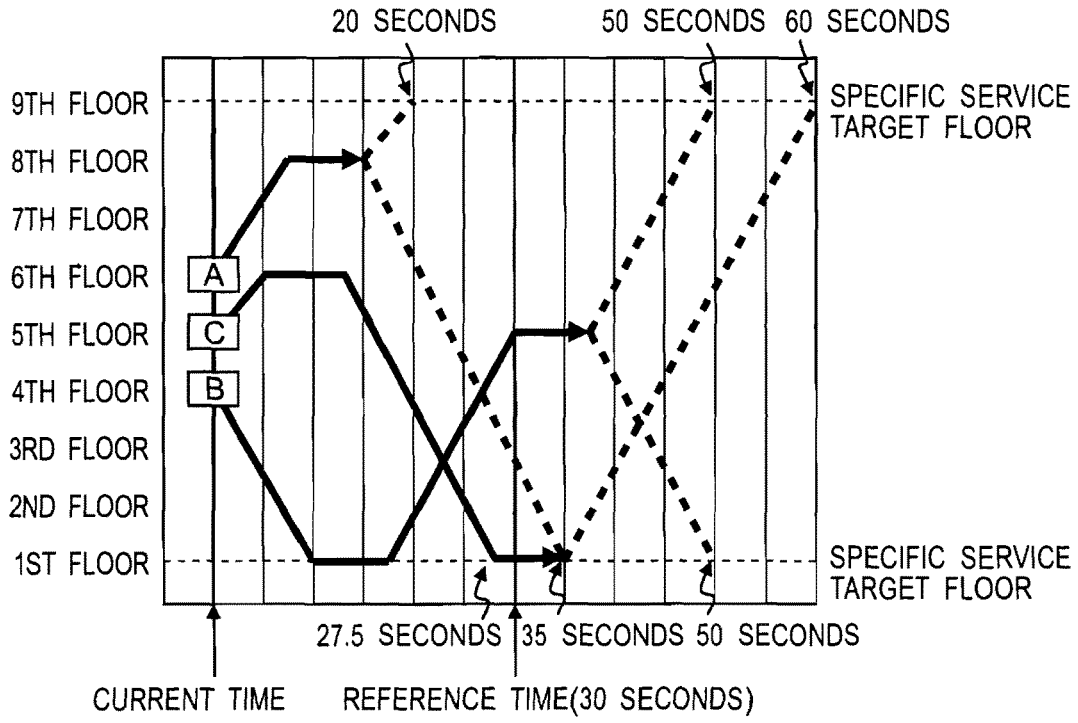
FIG. 10C is an elevator operation diagram for explaining an elevator assigning operation executed in response to a general destination floor call in the elevator group management system according to the first embodiment (example 1), and more specifically, illustrates that a new general destination floor call from the sixth floor to the first floor is temporarily assigned to an elevator C.

FIG. 9 is a cross-sectional view of an elevator shaft for explaining an elevator assigning operation executed in response to a general destination floor call in the elevator group management system according to the first embodiment (determination example 1). FIGS. 10A, 10B and 10C are elevator operation diagrams for explaining an elevator assigning operation executed in response to a general destination floor call in the elevator group management system according to the first embodiment (determination example 1). FIGS. 9, 10A, 10B and 10C illustrate that, for example, a new general destination floor call from the sixth floor to the first floor is inputted to the destination floor registering device 20. More specifically, FIG. 10A illustrates that the new general destination floor call from the sixth floor to the first floor is temporarily assigned to the elevator A. FIG. 10B illustrates that the new general destination floor call is temporarily assigned to the elevator B. FIG. 10C illustrates that the new general destination floor call is temporarily assigned to the elevator C. In addition, in each Figure, operation lines indicated by solid lines indicate operation lines related to a registered general destination floor call or the new general destination floor call.

Operation lines indicated by broken lines indicate operation lines related to the specific destination floor call temporarily assigned after the general destination floor call. In addition, the times illustrated in these figures are exemplary, and change according to a specification and an operation state of an elevator and an inter-floor distance.

(1) Temporary Assignment to Elevator A

As illustrated in FIG. 10A, when the general destination floor call from the sixth floor to the first floor is temporarily assigned to, for example, the elevator A, the elevator A responds to an existing destination floor call to the eighth floor, responds to a new destination floor call from the sixth floor to the first floor and then enters a state where the elevator A can respond to a specific destination floor call. In this regard, 45 seconds already pass at a point in time when the elevator A arrives at the first floor in response to the new destination floor call from the sixth floor to the first floor. That is, at this point in time, time longer than the reference time (30 seconds) passes. Hence, the elevator A is not an elevator which can respond to specific destination floor calls from the first floor and the ninth floor within the reference time. The response time of the elevator B to the ninth floor is 50 seconds, and the response time to the first floor is 50 seconds. Hence, the elevator B is not the elevator which can respond to the specific destination floor calls from the first floor and the ninth floor within the reference time. The response time of the elevator C to the ninth floor is 12.5 seconds, and the response time to the first floor is 12.5 seconds. Hence, the elevator C is an elevator which can respond to the specific destination floor calls from the first floor and the ninth floor within the reference time. Therefore, when the general destination floor call from the sixth floor to the first floor is temporarily assigned to the elevator A, there is an elevator (the elevator C) which can respond to the specific destination floor call from the first floor within the reference time, and there is an elevator (the elevator C) which can respond to the specific destination floor call from the ninth floor within the reference time. Consequently, the elevator A is determined as an assignment candidate elevator in response to the general destination floor call.

(2) Temporary Assignment to Elevator B

As illustrated in FIG. 10B, when the general destination floor call from the sixth floor to the first floor is temporarily assigned to, for example, the elevator B, the elevator B responds to an existing destination floor call from the first floor to the fifth floor, responds to a new destination floor call from the sixth floor to the first floor and then enters a state where the elevator B can respond to a specific destination floor call. In this regard, 37.5 seconds already pass at a point in time when, after arriving at the fifth floor in response to the existing destination floor call from the first floor to the fifth floor, the elevator B can depart. That is, at this point in time, time longer than the reference time (30 seconds) passes. Hence, the elevator B is not the elevator which can respond to the specific destination floor calls from the first floor and the ninth floor within the reference time. The response time of the elevator A to the ninth floor is 20 seconds, and the response time to the first floor is 35 seconds. Hence, the elevator A is an elevator which can respond to the specific destination floor call from the ninth floor within the reference time, yet is not an elevator which can respond to the specific destination floor call from the first floor within the reference time. Similar to the case where the general destination floor call is temporarily assigned to the elevator A, the response time of the elevator C to the ninth floor is 12.5 seconds and the response time to the first floor is 12.5 seconds. Hence, the elevator C is an elevator which can respond to the specific destination floor calls from the first floor and the ninth floor within the reference time. Therefore, when the general destination floor call from the sixth floor to the first floor is temporarily assigned to the elevator B, there is an elevator (the elevator C) which can respond to the specific destination floor call from the first floor within the reference time, and there are the elevator A and the elevator C which are elevators which can respond to the specific destination floor call from the ninth floor within the reference time. Consequently, the elevator B is determined as an assignment candidate elevator in response to the general destination floor call.

(3) Temporary Assignment to Elevator C

As illustrated in FIG. 10C, when the general destination floor call from the sixth floor to the first floor is temporarily assigned to, for example, the elevator C, the elevator C is on standby at the fifth floor without receiving the destination floor call, and therefore immediately responds to the new destination floor call from the sixth floor to the first floor, and then enters a state where the elevator C can respond to a specific destination floor call. In this case, the response time to the first floor is 27.5 seconds at a point in time when the elevator C arrives at the first floor in response to the new destination floor call from the sixth floor to the first floor. By contrast with this, the elevator C runs toward the ninth floor after having passengers get off the elevator at the first floor (at a point in time of 35 seconds), and therefore the response time to the ninth floor is 60 seconds. Hence, the elevator C is an elevator which can respond to the specific destination floor call from the first floor within the reference time, yet is not an elevator which can respond to the specific destination floor call from the ninth floor within the reference time. The elevator A is in the same state as that explained with reference to FIG. 8, and the response time to the ninth floor is 20 seconds, and the response time to the first floor is 35 seconds. Hence, the elevator A is an elevator which can respond to the specific destination floor call from the ninth floor within the reference time, yet is not an elevator which can respond to the specific destination floor call from the first floor within the reference time. The elevator B is in the same state as that explained with reference to FIG. 8, and the response time to the ninth floor is 50 seconds, and the response time to the first floor is 50 seconds. Hence, the elevator B is not the elevator which can respond to the specific destination floor calls from the first floor and the ninth floor within the reference time. Therefore, when the general destination floor call from the sixth floor to the first floor is temporarily assigned to the elevator C, there is an elevator (the elevator C) which can respond to the specific destination floor call from the first floor within the reference time, and there is an elevator (the elevator A) which can respond to the specific destination floor call from the ninth floor within the reference time. Consequently, the elevator C is determined as an assignment candidate elevator in response to the general destination floor call.

(4) Determination of Assignment Elevator

As described above, in the present example, each one of the elevator A, the elevator B and the elevator C can be an assignment candidate elevator in response to the general destination floor call from the sixth floor to the first floor. Hence, the control device 10 determines an assignment elevator from the elevator A, the elevator B and the elevator C according to a predetermined assign rule.

Determination Example 2

Figure 11:
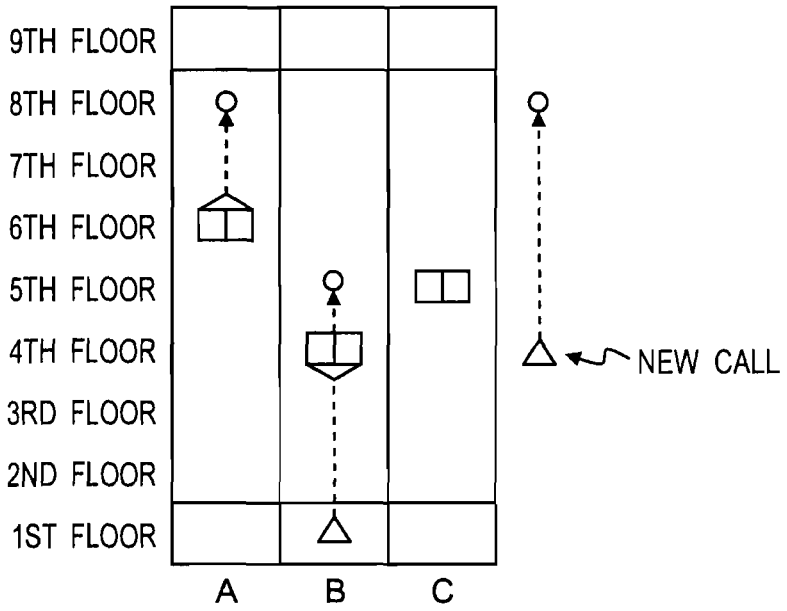
FIG. 11 is a cross-sectional view of an elevator shaft for explaining an elevator assigning operation executed in response to a general destination floor call in the elevator group management system according to the first embodiment (example 2).
Figure 12A:
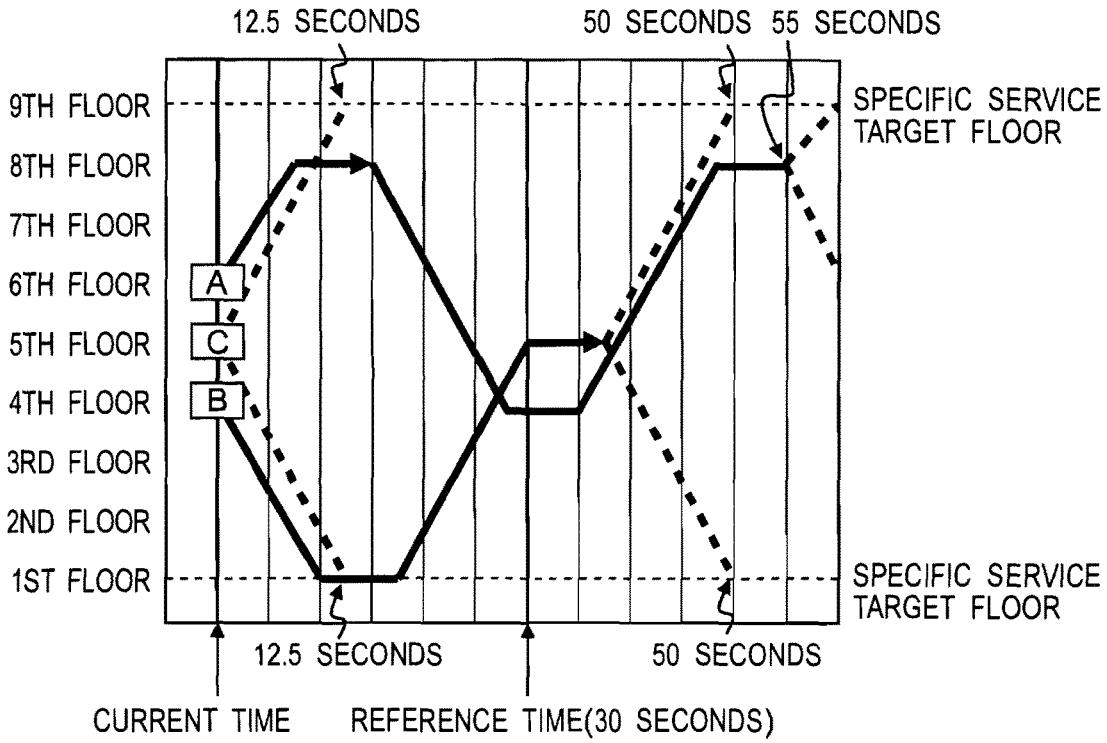
FIG. 12A is an elevator operation diagram for explaining an elevator assigning operation executed in response to a general destination floor call in the elevator group management system according to the first embodiment (example 2), and more specifically, illustrates that a new general destination floor call from a fourth floor to an eighth floor is temporarily assigned to the elevator A.
Figure 12B:
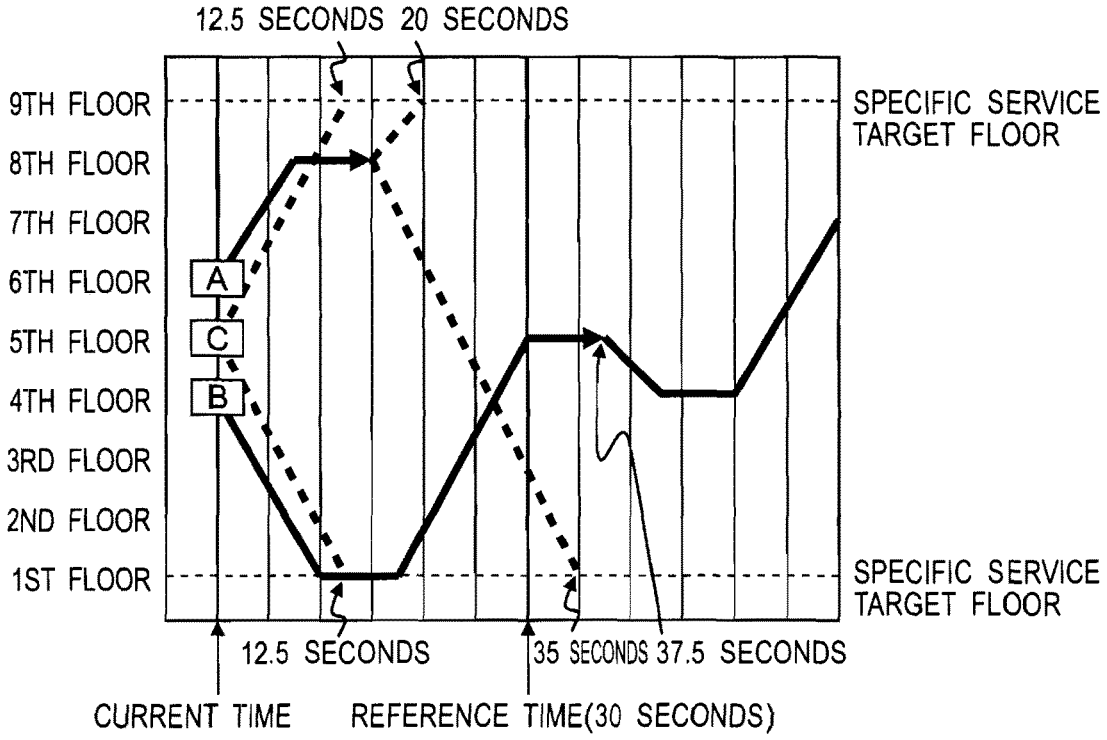
FIG. 12B is an elevator operation diagram for explaining an elevator assigning operation executed in response to a general destination floor call in the elevator group management system according to the first embodiment (example 2), and more specifically, illustrates that a new general destination floor call from the fourth floor to the eighth floor is temporarily assigned to the elevator B.
Figure 12C:
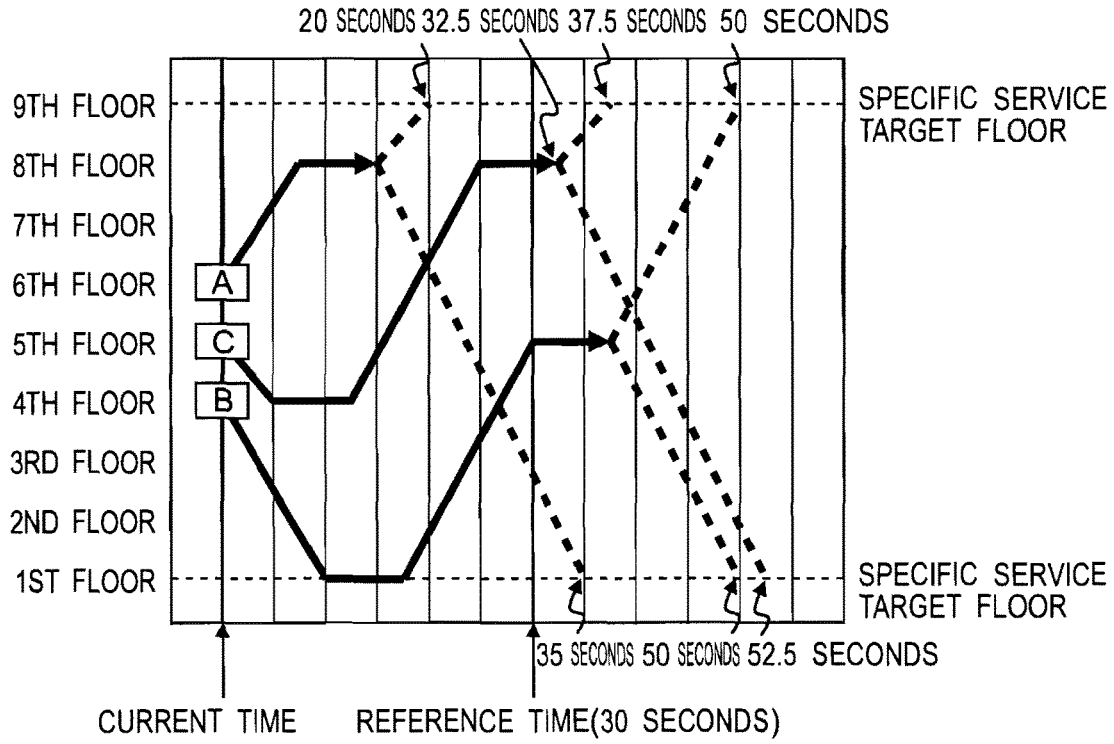
FIG. 12C is an elevator operation diagram for explaining an elevator assigning operation executed in response to a general destination floor call in the elevator group management system according to the first embodiment (example 2), and more specifically, illustrates that a new general destination floor call from the fourth floor to the eighth floor is temporarily assigned to the elevator C.

FIG. 11 is a cross-sectional view of an elevator shaft for explaining an elevator assigning operation executed in response to a general destination floor call in the elevator group management system according to the first embodiment (determination example 2). FIGS. 12A, 12B and 12C are elevator operation diagrams for explaining an elevator assigning operation executed in response to a general destination floor call in the elevator group management system according to the first embodiment (determination example 2). FIGS. 11, 12A, 12B and 12C illustrate that, for example, a new general destination floor call from the fourth floor to the eighth floor is inputted to the destination floor registering device 20. More specifically, FIG. 12A illustrates that the new general destination floor call from the fourth floor to the eighth floor is temporarily assigned to the elevator A. FIG. 12B illustrates that the new general destination floor call is temporarily assigned to the elevator B. FIG. 12C illustrates that the new general destination floor call is temporarily assigned to the elevator C. In addition, in each Figure, operation lines indicated by solid lines indicate operation lines related to an already registered general destination floor call or the new general destination floor call. Operation lines indicated by broken lines indicate operation lines related to the specific destination floor call temporarily assigned after the general destination floor call. In addition, the times illustrated in these figures are exemplary, and change according to a specification, an operation state and so on of an elevator and an inter-floor distance.

(1) Temporary Assignment to Elevator A

As illustrated in FIG. 12A, when the general destination floor call from the fourth floor to the eighth floor is temporarily assigned to, for example, the elevator A, the elevator A responds to an existing destination floor call to the eighth floor, responds to a new destination floor call from the fourth floor to the eighth floor and then enters a state where the elevator A can respond to a specific destination floor call. In this regard, 55 seconds already pass at a point in time when, after arriving at the eighth floor in response to the new destination floor call from the fourth floor to the eighth floor, the elevator A can depart. That is, at this point in time, time longer than the reference time (30 seconds) passes. Hence, the elevator A is not an elevator which can respond to specific destination floor calls from the first floor and the ninth floor within the reference time. The response time of the elevator B to the ninth floor is 50 seconds, and the response time to the first floor is 50 seconds. Hence, the elevator B is not the elevator which can respond to the specific destination floor calls from the first floor and the ninth floor within the reference time. The response time of the elevator C to the ninth floor is 12.5 seconds, and the response time to the first floor is 12.5 seconds. Hence, the elevator C is an elevator which can respond to the specific destination floor calls from the first floor and the ninth floor within the reference time. Therefore, when the general destination floor call from the fourth floor to the eighth floor is temporarily assigned to the elevator A, there is an elevator (the elevator C) which can respond to the specific destination floor call from the first floor within the reference time, and there is an elevator (the elevator C) which can respond to the specific destination floor call from the ninth floor within the reference time. Consequently, the elevator A is determined as an assignment candidate elevator in response to the general destination floor call.

(2) Temporary Assignment to Elevator B

As illustrated in FIG. 12B, when the general destination floor call from the fourth floor to the eighth floor is temporarily assigned to, for example, the elevator B, the elevator B responds to an existing destination floor call from the first floor to the fifth floor, responds to a new destination floor call from the fourth floor to the eighth floor and then enters a state where the elevator B can respond to a specific destination floor call. In this regard, 37.5 seconds already pass at a point in time when, after arriving at the fifth floor in response to the existing destination floor call from the first floor to the fifth floor, the elevator B can depart. That is, at this point in time, time longer than the reference time (30 seconds) passes. Hence, the elevator B is not the elevator which can respond to the specific destination floor calls from the first floor and the ninth floor within the reference time. The response time of the elevator A to the ninth floor is 20 seconds, and the response time to the first floor is 35 seconds. Hence, the elevator A is an elevator which can respond to the specific destination floor call from the ninth floor within the reference time, yet is not an elevator which can respond to the specific destination floor call from the first floor within the reference time. Similar to the case where the general destination floor call is temporarily assigned to the elevator A, the response time of the elevator C to the ninth floor is 12.5 seconds and the response time to the first floor is 12.5 seconds. Hence, the elevator C is an elevator which can respond to the specific destination floor calls from the first floor and the ninth floor within the reference time. Therefore, when the general destination floor call from the sixth floor to the first floor is temporarily assigned to the elevator B, there is an elevator (the elevator C) which can respond to the specific destination floor call from the first floor within the reference time, and there are the elevator A and the elevator C which are elevators which can respond to the specific destination floor call from the ninth floor within the reference time. Consequently, the elevator B is determined as an assignment candidate elevator in response to the general destination floor call.

(3) Temporary Assignment to Elevator C

As illustrated in FIG. 12C, when the general destination floor call from the fourth floor to the eighth floor is temporarily assigned to, for example, the elevator C, the elevator C is on standby at the fifth floor without receiving the destination floor call, and therefore immediately responds to the new destination floor call from the fourth floor to the eighth floor, and then enters a state where the elevator C can respond to a specific destination floor call. In this regard, 32.5 seconds already pass at a point in time when, after arriving at the eighth floor in response to the new destination floor call from the fourth floor to the eighth floor, the elevator B can depart. That is, at this point in time, time longer than the reference time (30 seconds) passes. In addition, when the elevator C subsequently responds to the specific destination floor call, the response time to the first floor is 52.5 seconds and the response time to the ninth floor is 37.5 seconds. Hence, the elevator C is not the elevator which can respond to both of the specific destination floor calls from the first floor and the ninth floor within the reference time. The response time of the elevator A to the ninth floor is 20 seconds, and the response time to the first floor is 35 seconds. Hence, the elevator A is an elevator which can respond to the specific destination floor call from the ninth floor within the reference time, yet is not an elevator which can respond to the specific destination floor call from the first floor within the reference time. The response time of the elevator B to the ninth floor is 50 seconds, and the response time to the first floor is 50 seconds. Hence, the elevator B is not the elevator which can respond to the specific destination floor calls from the first floor and the ninth floor within the reference time. Therefore, when the general destination floor call from the fourth floor to the eighth floor is temporarily assigned to the elevator C, there is an elevator (the elevator A) which can respond to the specific destination floor call from the ninth floor within the reference time, and there is not an elevator which can respond to the specific destination floor call from the first floor within the reference time. Consequently, the elevator C is not determined as an assignment candidate elevator in response to the general destination floor call.

(4) Determination of Assignment Elevator

As described above, in the present example, the elevator A and the elevator B other than the elevator C can be determined as an assignment candidate elevator in response to the general destination floor call from the fourth floor to the eighth floor. Hence, the control device 10 determines an assignment elevator from the elevator A and the elevator B according to a predetermined assign rule.

3. Conclusion

As described above, the elevator group management system according to the present embodiment is an elevator group management system which has the destination floor registering device 20 with which a user registers a destination floor and the control device 10 configured to assign one of a plurality of elevators based on the destination floor registered with the destination floor registering device 20 to a destination floor call that is based on the destination floor.

The destination floor registering device 20 has a destination floor input unit (the destination floor input unit 25 and the control unit 21) configured to input a destination floor from the user, and output a signal related to the inputted destination floor, and a user input unit (the card reader 26 and the control unit 21) configured to receive from a specific user, information indicating that a user inputting the information is the specific user, and output to the control device 10 a specific signal indicating that a user is the specific user.

The control device 10 has the storage unit 12 configured to store a reference time and a specific floor associated with the specific user, and the control unit 11.

When the destination floor call is a specific destination floor call, the control unit 11 of the control device 10 assigns an elevator of which waiting time is within the reference time from the plurality of elevators to the destination floor call, the specific destination floor call being a call made with the specific signal indicating the specific user is inputted when the signal related to the destination floor is inputted from the destination floor registering device 20, the waiting time being a time from a time when the specific destination floor call is made to a time when the specific user can get on an elevator at the specific floor. Further, when the destination floor call is a general destination floor call, the control unit 11 of the control device 10 assigns one of the plurality of elevators in response to the general destination floor call to the destination floor call such that an elevator of which waiting time to the specific destination floor call that is made after the general destination floor call is within the reference time is left, the general destination floor call being a call made with the specific signal not inputted when the signal related to the destination floor is inputted from the destination floor registering device 20.

According to the present embodiment, when a general destination floor call is made, one of a plurality of elevators is assigned in response to the general destination floor call such that an elevator of which waiting time to a specific destination floor call that is made after the general destination floor call is within a reference time is left. Consequently, the specific user can get on one of the elevators within the reference time after inputting a destination floor, or can get off the elevator at the destination floor within the reference time after inputting the destination floor. Consequently, the elevator group management system that includes a destination floor registering device can preferentially provide service to specific users.

Further, it is possible to provide priority service to a specific user without changing an assign of a call and avoid that general users feel uncomfortable.

Furthermore, in the present embodiment, the destination floor registering devices 20 are installed on all floors. Consequently, it is possible to determine an operation route of each elevator in response to the registered call. Consequently, it is possible to precisely predict a response time (waiting time) to a specific destination floor call, and to perform the above assign control.

In the elevator group management system according to the present embodiment, the control unit 11 of the control device 10 assumes that the general destination floor call is assigned to each of the plurality of elevators when the general destination floor call is made, and determines whether or not there is an elevator of which waiting time for the specific destination floor call which is made after the general destination floor call is within the reference time. When there is it is determined that an elevator of which waiting time is within the reference time, the control unit 11 sets the elevator to which the determination as to the waiting times is performed, as an assignment candidate elevator to the general destination floor call. When it is determined that there is not an elevator of which waiting time is within the reference time, the control unit 11 does not set the elevators to which determination as to the waiting times is performed, as assignment candidate elevators to the general destination floor call. The control unit 11 determines an assignment elevator to be assigned in response to the general destination floor call from the assignment candidate elevators according to a predetermined rule.

Thus, when there is an elevator which a user can get on within the reference time, an elevator to which determination as to the waiting time is performed is set as an assignment candidate elevator to be assigned in response to the general destination floor call. However, when there is not an elevator that the user can get on within the reference time, the elevator to which determination as to the waiting times is performed is not set as an assignment candidate elevator to be assigned in response to the general destination floor call. Consequently, by performing control according to the present embodiment from the beginning, an elevator that a user can get on within the reference time is left. Further, an assignment elevator to be assigned in response to the general destination floor call is determined from the assignment candidate elevator according to a predetermined rule.

In the elevator group management system according to the present embodiment, the control unit 11 of the control device 10 assumes that the specific destination floor call is assigned to each of the plurality of elevators when the specific destination floor call is made, and determines whether or not a waiting time for the specific destination floor call with respect to the assumed elevator is within the reference time. Further, when it is determined that the waiting time is within the reference time, the control unit 11 of the control device 10 sets elevators to which the determination as to the waiting time is performed, as the assignment candidate elevator in response to the specific destination floor call. When it is determined that the waiting time is not within the reference time, the control unit 11 does not set the elevator to which determination as to the waiting time is performed, as assignment candidate elevators in response to the specific destination floor call. The control unit 11 determines an assignment elevator to be assigned in response to the specific destination floor call from the assignment candidate elevator according to a predetermined rule.

Thus, an elevator of which waiting time is within the reference time is set as an assignment candidate elevator in response to the specific destination floor call. However, an elevator of which waiting time is not within the reference time is not set as an assignment candidate elevator in response to the specific destination floor call. Further, an assignment elevator to be assigned in response to the specific destination floor call is determined from the assignment candidate elevator according to a predetermined rule.

Second Embodiment

An elevator group management system according to the second embodiment of the present invention will be described with reference to the drawings. In addition, differences from the first embodiment will be mainly described.

In the elevator group management system according to the first embodiment, a control device performs an assigning operation based on a response time (waiting time). In the present embodiment, the control device performs an assigning operation based on a service completion time (described below).

An elevator group management system according to the second embodiment will be described in detail below.

1. Configuration

A hardware configuration of the elevator group management system according to the present embodiment is the same as the elevator group management system according to the first embodiment. However, in a storage unit 12, a program different from the program in the first embodiment is stored. Further, when the program is executed by a control unit 11, an operation unique to the elevator group management system according to the second embodiment is realized.

2. Operation

The elevator group management system according to the present embodiment differs from the first embodiment in an operation of processing of determining assignment candidate elevators. The other operations are the same as those in the first embodiment. Hence, the processing of determining the assignment candidate elevators will be mainly described.

Figure 13:
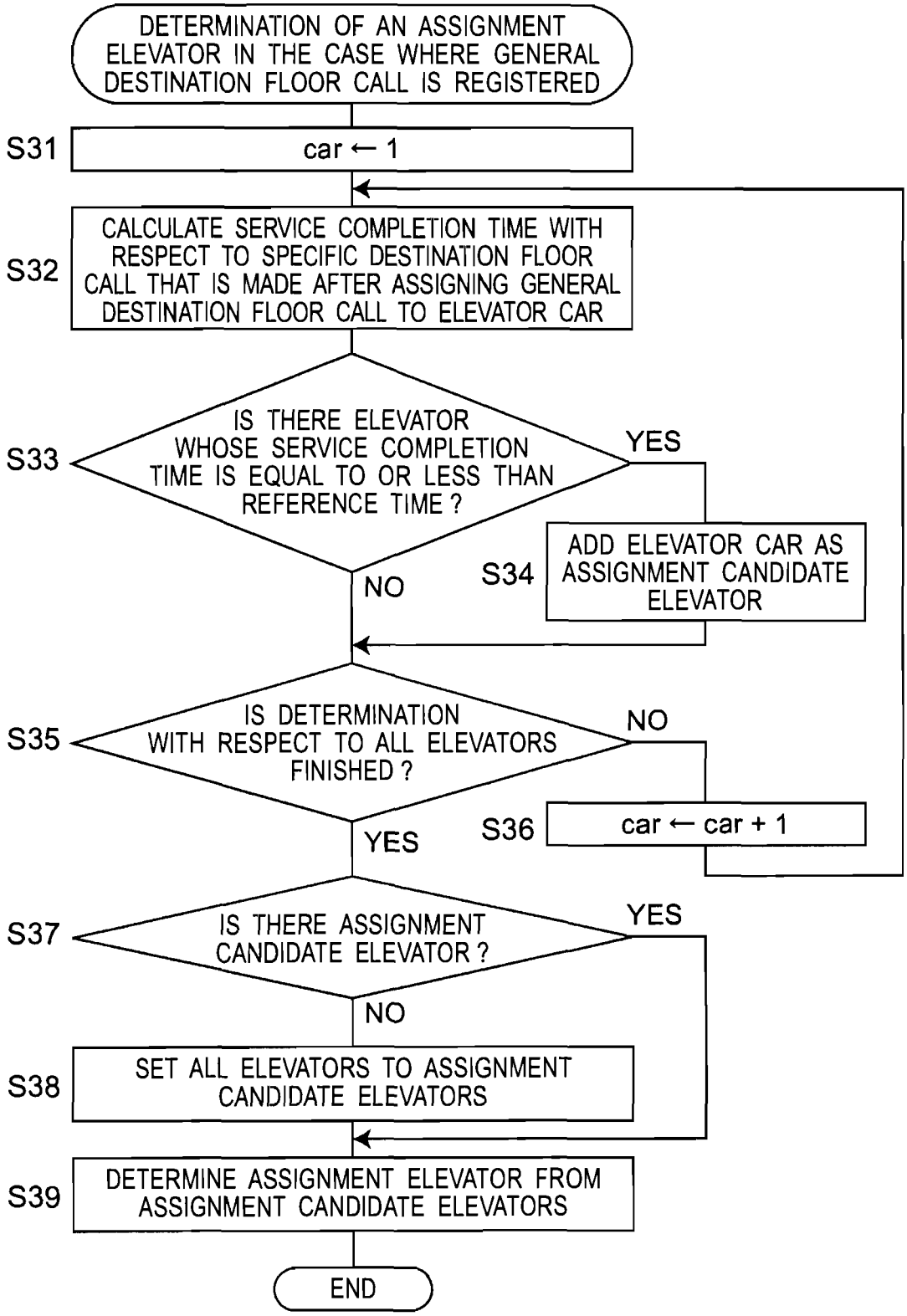
FIG. 13 is a flowchart illustrating a flow of an elevator assigning operation executed in response to a general destination floor call in an elevator group management system according to a second embodiment.

FIG. 13 is a flowchart illustrating a flow of an elevator assigning operation executed in response to a general destination floor call in an elevator group management system according to the second embodiment.

In steps S31 and S34 to S39 in the present flowchart, the same processing as those in steps S11 and S14 to S19 in the flowchart in FIG. 5 according to the first embodiment is performed.

In step S32, when a general destination floor call is assigned to an elevator X, a control device 10 calculates a service completion time in response to a specific destination floor call which is likely to be made after the general destination floor call. The service completion time refers to a time from a time when a specific user gets on an elevator at a specific service target floor after a specific destination floor call is made to a time when the specific user can get off the elevator at a destination floor.

In step S33, the control device 10 determines whether or not there is an elevator of which service completion time to the specific destination floor call that is made after the general destination floor call is within the reference time. In addition, in the present embodiment, the reference time is set to, for example, 60 seconds. However, the reference time is not limited to this, and may be longer or shorter than 60 seconds. When the reference time is made longer, it is possible to increase the number of assignment candidate elevators. However, a service completion time of a user who makes a specific destination floor call becomes longer. When the reference time is made shorter, a service completion time of a user who makes a specific destination floor call becomes shorter. However, the number of assignment candidate elevators decreases.

When there is an elevator of which calculated service completion time is within the reference time (YES in S33), the control device 10 executes processing subsequent to step S34 similar to the first embodiment. By contrast with this, when there is not an elevator of which calculated service completion time is within the reference time (NO in S33), the control device 10 executes processing subsequent to step S35 similar to the first embodiment.

Figure 14:
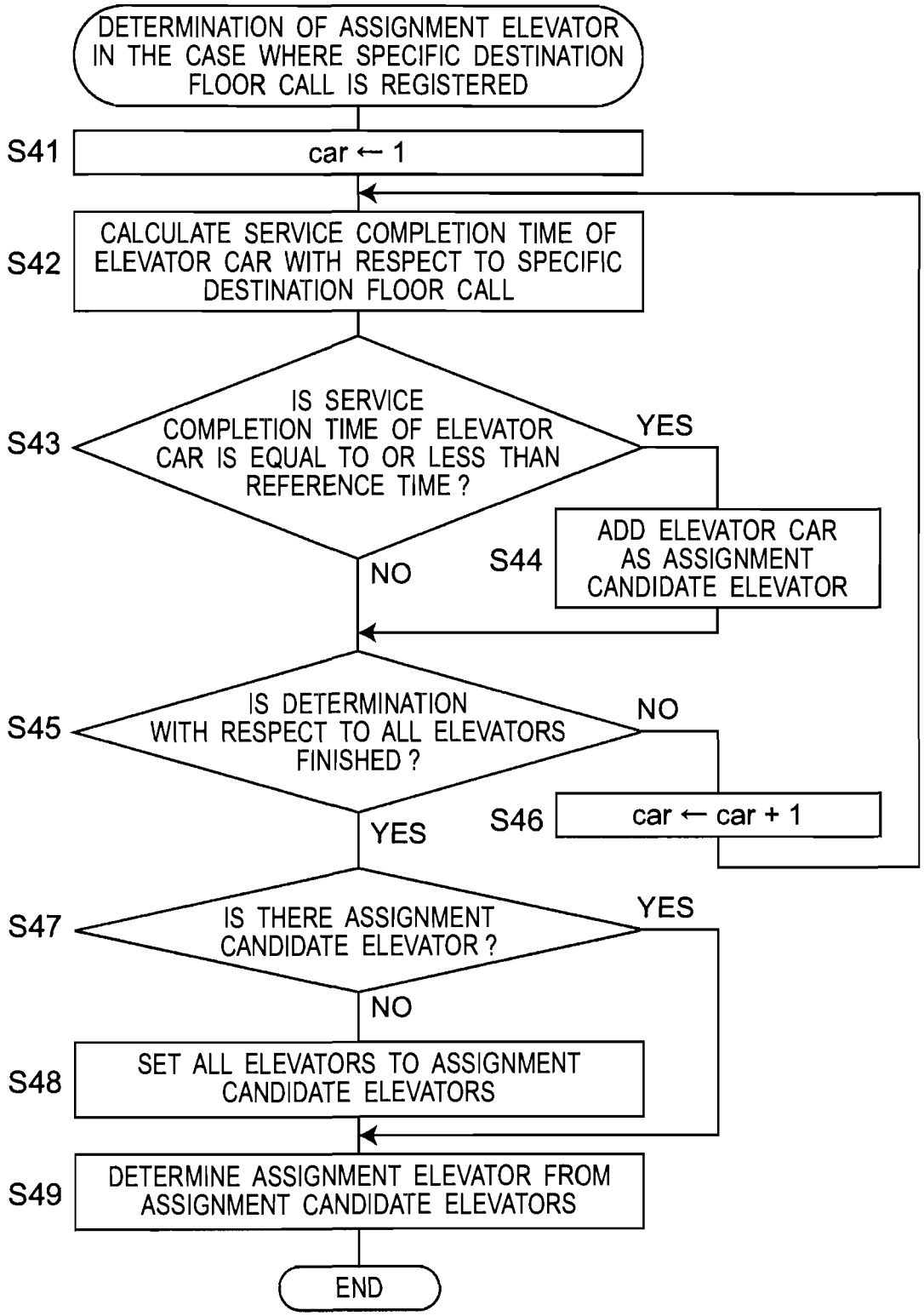
FIG. 14 is a flowchart illustrating a flow of an elevator assigning operation executed in response to a specific destination floor call in the elevator group management system according to the second embodiment.

FIG. 14 is a flowchart illustrating a flow of an elevator assigning operation executed in response to a specific destination floor call in the elevator group management system according to the second embodiment.

In steps S41 and S44 to S49 in the present flowchart, the same processing as those in steps S21 and S24 to S29 in the flowchart in FIG. 6 according to the first embodiment is performed.

In step S42, the control device 10 calculates a service completion time when a specific destination floor call is assigned to an elevator X. As described above, the service completion time refers to a time from a time when a specific user gets on an elevator after a specific destination floor call is made to a time when the specific user can get off the elevator.

In step S43, the control device 10 determines whether or not a service completion time of the elevator X in response to a specific destination floor call is within the reference time. Further, when the calculated service completion time is within the reference time (YES in S43), the control device 10 executes processing subsequent to step S44 similar to the first embodiment. By contrast with this, when the calculated service completion time is not within the reference time (NO in S43), the control device 10 executes processing subsequent to step S45 similar to the first embodiment.

3. Conclusion

As described above, in the elevator group management system according to the second embodiment, when a destination floor call is a specific destination floor call, the specific destination floor call being a call made with the specific signal indicating that the user is a specific user is inputted when the signal related to the destination floor is inputted from the destination floor registering device 20, the control unit 11 of the control device 10 assigns an elevator of which service completion time is within the reference time from the plurality of elevators to the destination floor call, the service completion time being a time from a time when the specific user gets on an elevator at the specific floor after a specific destination floor call is made to a time when the specific user can get off the elevator at the destination floor. Further, when the destination floor call is a general destination floor call, the control unit 11 of the control device 10 assigns one of the plurality of elevators to a general destination floor call such that an elevator of which service completion expected time in response to the specific destination floor call that is made after the general destination floor call is within the reference time is left, the general destination floor call being a call made with the specific signal indicating the user is the specific user not inputted when the signal related to the destination floor is inputted from the destination floor registering device 20.

Thus, when a general destination floor call is made, one of a plurality of elevators is assigned in response to the general destination floor call to the destination floor call such that an elevator of which service completion expected time to a specific destination floor call that is made after the general destination floor call is within a reference time is left. Consequently, the specific user can get on one of the elevators within the reference time after inputting a destination floor, or can get off the elevator at the destination floor within the reference time after inputting the destination floor. Consequently, the elevator group management system that includes a destination floor registering device can preferentially provide service to specific users.

In the elevator group management system according to the present embodiment, the control unit 11 of the control device 10 assumes that the general destination floor call is assigned to each of the plurality of elevators when the general destination floor call is made, and determines whether or not there is an elevator of which service completion time for the specific destination floor call which is made after the general destination floor call is within the reference time. When it is determined that there is an elevator of which service completion time is within the reference time, the control unit 11 sets the elevator to which the determination as to the service completion times is performed, as an assignment candidate elevator in response to the general destination floor call. When it is determined that there is not an elevator of which service completion time is within the reference time, the control unit 11 does not set the elevator to which the determination as to the service completion time is performed, as the assignment candidate elevator in response to the general destination floor call. The control unit 11 determines an assignment elevator to be assigned in response to the general destination floor call from the assignment candidate elevators according to a predetermined rule.

Thus, when there is an elevator that a user can get off within the reference time, the elevator to which determination as to the service completion time is performed is set as an assignment candidate elevator in response to the general destination floor call. However, when there is not an elevator of which service completion time is within the reference time, the elevator to which the determination as to the service completion time is performed is not set as the assignment candidate elevator in response to the general destination floor call. Consequently, by performing control according to the present embodiment from the beginning, an elevator that a user can get off within the reference time is left. Further, an assignment elevator to be assigned in response to the general destination floor call is determined from the assignment candidate elevators according to a predetermined rule.

In the elevator group management system according to the present embodiment, the control unit 11 of the control device 10 assumes that the specific destination floor call is assigned to each of the plurality of elevators when the specific destination floor call is made, and determines whether or not a service completion time in response to the specific destination floor call is within the reference time. When the service completion time is within the reference time, the control unit 11 sets the elevator to which the determination as to the service completion time is performed, as an assignment candidate elevator in response to the specific destination floor call. When the service completion time is not within the reference time, the control unit 11 does not set the elevator to which the determination as to the service completion time is performed, as the assignment candidate elevator in response to the specific destination floor call. The control unit 11 determines an assignment elevator to be assigned in response to the specific destination floor call from the assignment candidate elevators according to a predetermined rule.

Thus, an elevator of which service completion time is within the reference time is set as an assignment candidate elevator in response to the specific destination floor call. However, when the completion time is not within the reference time is not set as an assignment candidate elevator in response to the specific destination floor call. Further, an assignment elevator to be assigned in response to the specific destination floor call is determined from the assignment candidate elevators according to a predetermined rule.

Other Embodiments

In each of the above embodiments, the control device 10 computes the response time (waiting time) assuming that, after finishing services for all destination floor call assigned to each elevator, a response to the specific destination floor call is made. However, when an empty elevator cage does not need to be provided to a specific user, this computing method may not be adopted. When, for example, an elevator related to the registered general destination floor call provides service to the same floor as a specific service target floor in response to the specific destination floor call, the control device 10 may assign this elevator.

Although the present invention has been described in connection with specified embodiments thereof, many other modifications, corrections and applications are apparent to those skilled in the art. Therefore, the present invention is not limited by the disclosure provided herein but limited only to the scope of the appended claims. The present disclosure relates to subject matter contained in Japanese Patent Application No. 2013-205257, filed on Sep. 30, 2013, which is expressly incorporated herein by reference in its entirely.

What is claimed is:

1. An elevator group management system comprising:

a destination floor registering device with which a user inputs a destination floor; and a control device configured to assign one of a plurality of elevators based on the destination floor registered with the destination floor registering device to a destination floor call that is based on the destination floor, wherein the destination floor registering device comprises a destination floor input unit configured to input a destination floor from the user, and output a signal related to the input destination floor to the control device, and a user input unit configured to receive from a specific user, information indicating that a user inputting the information is the specific user, and output to the control device a specific signal indicating that a user is the specific user, the control device comprises a storage unit configured to store a reference time and a specific floor associated with the specific user, and a control unit, wherein when the destination floor call is a specific destination floor call, the control unit assigns an elevator of which waiting time is within the reference time from the plurality of elevators to the destination floor call, the specific destination floor call being a call made with the specific signal is inputted when the signal related to the destination floor is inputted from the destination floor registering device, the waiting time being a time from a time when the specific destination floor call is made to a time when the specific user can get on an elevator at the specific floor, and when the destination floor call is a general destination floor call, the control unit assigns one of the plurality of elevators in response to the general destination floor call to the destination floor call such that an elevator of which waiting time to the specific destination floor call which is made after the general destination floor call is within the reference time is left, the general destination floor call being a call made with the specific signal not inputted when the signal related to the destination floor is inputted from the destination floor registering device.

2. The elevator group management system according to claim 1, wherein the control unit assumes that the general destination floor call is assigned to each of the plurality of elevators when the general destination floor call is made, and determines whether or not there is an elevator of which waiting time for the specific destination floor call which is made after the general destination floor call is within the reference time, when it is determined that there is an elevator of which waiting time is within the reference time, the control unit sets the elevator to which the determination as to the waiting time is performed, as a candidate elevator to the general destination floor call, when it is determined that there is no elevator of which waiting time is within the reference time, the control unit does not set the elevator to which the determination as to the waiting time is performed, as the candidate elevator to the general destination floor call, and the control unit determines an elevator to be assigned in response to the general destination floor call from the candidate elevators according to a predetermined rule.

3. The elevator group management system according to claim 1, wherein the control unit assumes that the specific destination floor call is assigned to each of the plurality of elevators when the specific destination floor call is made, and determines whether or not a waiting time for the specific destination floor call with respect to the assumed elevator is within the reference time, when it is determined that the waiting time is within the reference time, the control unit sets the elevator to which the determination as to the waiting time is performed, as a candidate elevator in response to the specific destination floor call, when it is determined that the waiting time is not within the reference time, the control unit does not set the elevator to which the determination as to the waiting time is performed, as the candidate elevator in response to the specific destination floor call, and the control unit determines an elevator to be assigned in response to the specific destination floor call from the candidate elevators according to a predetermined rule.

4. An elevator group management system comprising:

a destination floor registering device with which a user registers a destination floor; and a control device configured to assign one of a plurality of elevators based on the destination floor registered with the destination floor registering device to a destination floor call that is based on the destination floor, wherein the destination floor registering device comprises a destination floor input unit configured to input a destination floor from the user, and output a signal related to the inputted destination floor to the control device, and a user input unit configured to receive from a specific user, information indicating that a user inputting the information is the specific user, and output to the control device a specific signal indicating that a user is the specific user, the control device comprises a storage unit configured to store a reference time and a specific floor associated with the specific user, and a control unit, wherein when the destination floor call is a specific destination floor call, the control unit assigns an elevator of which service completion time is within the reference time from the plurality of elevators to the destination floor call, the specific destination floor call being a call made with the specific signal is inputted when the signal related to the destination floor is inputted from the destination floor registering device, the service completion time being a time from a time when the specific user gets on an elevator at the specific floor after a specific destination floor call is made to a time when the specific user can get off the elevator at the destination floor, and when the destination floor call is a general destination floor call, the control unit assigns one of the plurality of elevators in response to the general destination floor call to the destination floor call such that an elevator of which service completion expected time at which a service is expected to complete to the specific destination floor call which is made after the general destination floor call is within the reference time is left, the general destination floor call being a call made with the specific signal not inputted when the signal related to the destination floor is inputted from the destination floor registering device.

5. The elevator group management system according to claim 4, wherein the control unit assumes that the general destination floor call is assigned to each of the plurality of elevators when the general destination floor call is made, and determines whether or not there is an elevator of which service completion time for the specific destination floor call which is made after the general destination floor call is within the reference time, when it is determined that there is an elevator of which service completion time is within the reference time, the control unit sets the elevator to which the determination as to the service completion time is performed, as a candidate elevator in response to the general destination floor call, when it is determined that there is no elevator of which service completion time is within the reference times, the control unit does not set the elevator to which the determination as to the service completion time is performed, as the candidate elevator to be assigned in response to the general destination floor call, and the control unit determines an elevator to be assigned in response to the general destination floor call from the candidate elevators according to a predetermined rule.

6. The elevator group management system according to claim 4, wherein the control unit assumes that the specific destination floor call is assigned to each of the plurality of elevators when the specific destination floor call is made, and determines whether or not a service completion time for the specific destination floor call with respect to the assumed elevator is within the reference time, when it is determined that the service completion time is within the reference time, the control unit sets the elevator to which the determination as to the service completion time is performed, as a candidate elevator to the specific destination floor call, when it is determined that the service completion time is not within the reference time, the control unit does not set the elevator to which the determination as to the service completion time is performed, as the candidate elevator to the specific destination floor call, and the control unit determines an elevator to be assigned in response to the specific destination floor call from the candidate elevators according to a predetermined rule.

* * * * *